US007861402B2

(12) United States Patent
Eckl et al.

(10) Patent No.: US 7,861,402 B2
(45) Date of Patent: Jan. 4, 2011

(54) METHOD FOR PRODUCTION OF A POLE FACE OF A METALLIC CLOSING ELEMENT OF AN ELECTROMAGNET

(75) Inventors: Peter Eckl, Amberg (DE); Johann Hofrichter, Schmidgaden (DE)

(73) Assignee: Siemens Aktiengesellschaft, Munich (DE)

( * ) Notice: Subject to any disclaimer, the term of this patent is extended or adjusted under 35 U.S.C. 154(b) by 141 days.

(21) Appl. No.: 11/791,757

(22) PCT Filed: Jun. 29, 2006

(86) PCT No.: PCT/EP2006/063708

§ 371 (c)(1),
(2), (4) Date: May 29, 2007

(87) PCT Pub. No.: WO2007/000474

PCT Pub. Date: Jan. 4, 2007

(65) Prior Publication Data

US 2008/0122561 A1 May 29, 2008

(30) Foreign Application Priority Data

Jun. 29, 2005 (DE) ..... 10 2005 030 376

(51) Int. Cl.
*H01F 7/06* (2006.01)

(52) U.S. Cl. ..... 29/606; 29/602.1; 29/605; 156/153; 156/191; 156/193; 156/305; 310/43; 310/210; 310/235; 335/297; 336/122

(58) Field of Classification Search ..... 29/602.1, 29/605, 606; 156/153, 191, 193, 305; 310/43, 310/210, 235; 335/297; 336/122
See application file for complete search history.

(56) References Cited

U.S. PATENT DOCUMENTS

| | | | | |
|---|---|---|---|---|
| 2,975,312 | A | 3/1961 | Ploran | |
| 3,410,980 | A | 11/1968 | Gugger et al. | |
| 4,042,898 | A | 8/1977 | Tomita et al. | |
| 4,486,279 | A * | 12/1984 | Fromson et al. | 205/653 |
| 5,074,687 | A | 12/1991 | Gugel et al. | |
| 5,265,320 | A * | 11/1993 | Greenway | 29/596 |
| 6,107,718 | A | 8/2000 | Schustek et al. | |

(Continued)

FOREIGN PATENT DOCUMENTS

CN 2172906 7/1994

(Continued)

OTHER PUBLICATIONS

VDWF im Dialog, http://www.vdwf.de/VDWF-Magazin/vdwf_id_01_2005.pdf; Magazine, 2005; DE.

(Continued)

*Primary Examiner*—Paul D Kim
(74) *Attorney, Agent, or Firm*—Harness, Dickey & Pierce, P.L.C.

(57) ABSTRACT

A method is disclosed for producing a pole face of a metal closing elements of a solenoid, especially for electromechanical switchgear. In at least one embodiment, the method includes machining the surface of a crude stamped part of the closing element to give the pole face. A corresponding armature, yoke, solenoid and switchgear are also disclosed.

14 Claims, 7 Drawing Sheets

U.S. PATENT DOCUMENTS

| | | | |
|---|---|---|---|
| 6,864,175 | B2 | 3/2005 | Engelhardt et al. |
| 6,924,575 | B2 * | 8/2005 | Baumeister et al. ..... 310/216 |

FOREIGN PATENT DOCUMENTS

| | | | |
|---|---|---|---|
| DD | 29180 | | 10/1959 |
| DE | 840285 | | 5/1952 |
| DE | 1158174 | | 11/1963 |
| DE | 1 938 702 | | 5/1966 |
| DE | 1938702 | | 5/1966 |
| DE | 3818276 | | 12/1989 |
| DE | 41 20 149 | | 12/1992 |
| DE | 4120149 | | 12/1992 |
| DE | 195 49 180 | | 7/1997 |
| DE | 19549180 | | 7/1997 |
| DE | 102005030376 | | 3/2009 |
| EP | 0133858 | | 3/1985 |
| EP | 0 338 175 | | 10/1989 |
| EP | 0338175 | A1 | 10/1989 |
| EP | 0338175 | B1 | 3/1993 |
| EP | 1 193 742 | | 4/2002 |
| EP | 1193724 | | 4/2002 |
| EP | 1193742 | | 4/2002 |
| GB | 532905 | | 2/1941 |
| GB | 920049 | | 3/1963 |
| GB | 920049 | A | 3/1963 |
| JP | 11239909 | A * | 9/1999 |

OTHER PUBLICATIONS

DIN 8589-03 Fertigungsverfahren Spanen, Teil 3, Frasen—Einordnung, Unterteilung, Begriffe; Others; 2003; DE (with English translation).

DIN 8589-11 Fertigungsverfahren Spanen, Teil 11, Schleifen mit rotierendem Werkzeug, Einordnung, Unterteilung, Begriffe, Others; 2003; DE (with English translation).

Letter of Opposition for German patent application DE 10 2005 030 376 dated Jun. 17, 2009 (with English translation).

Letter of Opposition for German patent application DE 10 2006 030 431 dated Sep. 1, 2009 (with English translation).

Office Action for Chinese patent application No. 2006800187702 dated Feb. 12, 2010.

Office Action for application No. 06 763 970.8 dated Sep. 16, 2010 (in German).

* cited by examiner

METHOD FOR PRODUCTION OF A POLE FACE OF A METALLIC CLOSING ELEMENT OF AN ELECTROMAGNET

PRIORITY STATEMENT

This application is the national phase under 35 U.S.C. §371 of PCT International Application No. PCT/EP2006/063708 which has an International filing date of Jun. 29, 2006 which designated the United States of America and which claims priority on German Patent Application number 10 2005 030 376.5 filed Jun. 29, 2005, the entire contents of which are hereby incorporated herein by reference.

FIELD

Embodiments of the invention generally relate to a method for production of a pole face of a metallic closing element of an electromagnet, in particular for an electromechanical switching device. Embodiments of the invention also generally relate to a yoke and an armature as well as an electromagnet, in particular for an electromechanical switching device.

BACKGROUND

Electromagnetic actuating drives are required for opening and closing of the electrical contacts in an electromechanical switching device, such as a contactor or a relay. An electromagnet which has an armature and a yoke as closing elements represents a major part in actuating elements such as these. When a current flows through the coils of the electromagnet, then the resultant magnetic field accelerates the armature toward the yoke, until the pole faces of the armature and yoke rest on one another. When the current through the coils of the electromagnet is switched off, then the armature and yoke are opened again, generally by a mechanical resetting device, such as springs and the like. Moving contact pieces, which are connected to the armature, are moved with respect to stationary contact pieces in order to close and open the electrical contacts in an electromechanical switching device.

When the pole faces of the armature and yoke are resting on one another in the closed state, then adhesion forces are produced which prevent rapid opening. This has a disadvantageous effect on the switching times of the electromechanical switching device. For this reason, the pole faces of the closing elements of the electromagnet for an electromechanical switching device must have a certain roughness, which reduces the mutual adhesion between the pole faces. On the other hand, the pole faces must be flat since, otherwise, there would be an air gap between the closing elements, weakening the secondary flux in the magnet system. This leads to a reduction in the holding force and to an undesirable increase in the tendency of the switching device to hum.

In order to achieve the desired surface characteristics of the pole faces, it is already known for that surface of the closing element (which is normally in the form of a stamped part) which is intended to be used as the pole face to be treated by means of grinding disks. The surface character can be set by the choice of the grinding material applied to the grinding disks, for example corundum, and its granularity. One disadvantage is that a desirable narrow tolerance band cannot be achieved for the surface character.

SUMMARY

In at least one embodiment of the invention, a method is specified which allows a narrow tolerance band to be achieved for the surface character of the pole face, with good reproducibility. In at least one embodiment of the invention, an electromagnet is specified whose use in a switching device results in a narrow switching-time tolerance band.

In at least one embodiment, one surface of a rough stamped part of the closing element is processed to form the pole surface by means of a machining method, for example milling.

At least one embodiment of the invention is based on the idea that a narrow tolerance band cannot be achieved for the surface character of the pole face by grinding. This is because the grinding material which is applied to grinding disks is always distributed inhomogenously. Furthermore, the shape and the size of the individual particles of the grinding material that is applied are subject to significant variability, even with predetermined granularity. For this reason, a surface to be treated cannot be processed indefinitely accurately by grinding, even by using grinding machines which work completely exactly.

In a further step, at least one embodiment of the invention departs the engineering prejudice that the pole faces of the closing elements of an electromagnet which is intended in particular for an electromechanical switching device must be treated by grinding. At least one embodiment of the invention has identified the fact that the described uncertainties do not occur when using milling for removal of the surface, in contrast to grinding. In contrast to grinding disks, milling tools have defined cutters, which are subject only to aging or wear.

If the surface of a raw stamped part of the closing element is accordingly not processed by grinding but by a machining method, for example by means of milling, then narrow surface character tolerances can be achieved. Different requirements for the roughness or planarity of the surface character of the pole faces can be produced just by defined machine settings.

Surface treatment can be carried out using conventional milling machines and conventional milling tools which can be adjusted sufficiently accurately in terms of the material to be removed.

At least one embodiment of the invention additionally offers the advantage that a multiplicity of different requirements relating to the surface character of pole faces, for example for different variants of the same electromagnet, can be satisfied solely by setting machine parameters. Furthermore, the use of milling for machining results in the workpiece to be processed being heated only to a relatively minor extent. Both wet processing and dry processing are possible.

The use of embodiments of the described method is not restricted to specific materials or specific compositions of the stamped parts. In particular, it can be used for all ferromagnetic materials for the closing elements of the electromagnet. In particular, at least one embodiment of the described method is also suitable for treating the surfaces of laminated closing elements which are normally used for electromagnets in switching devices. In this case, a laminated core is used as the raw stamped part, with the laminates of the laminated core being packetized transversely with respect to the surface. The individual laminates are in this case riveted closely to one another. The stamped laminates have stamping burrs and uneven features removed from them by the use of milling. At the same time, the material removal results in the pole face having the desired surface characteristics.

The milling of the surface is advantageously subjected to open-loop and/or closed-loop control using the feed rate and the rotation speed of the milling tool as input variables. The rotation speed of the milling tool in conjunction with the feed rate controls the feed and thus the material removed per tooth or cutter of the milling tool. This allows the desired roughness and the desired planarity of the pole face to be set.

At least one embodiment of the invention is directed to an electromagnet including a metallic closing element, whose pole face is produced using at least one embodiment of the described method.

Since the surface character of a pole face produced using the described method has a narrow tolerance band, a switching device in which an electromagnet such as this is used likewise has a narrow tolerance range for its switching time.

BRIEF DESCRIPTION OF THE DRAWINGS

Example embodiments of the invention are explained in the examples illustrated in FIGS. 1 to 9, in which.

The same reference symbols relate to similar structural elements in all of the figures.

DETAILED DESCRIPTION OF THE EXAMPLE EMBODIMENTS

Example 1

The surface of a laminated yoke of an electromagnet for a contactor has been milled away to form the pole face in a plurality of trials series using a commercially available milling machine.

A standard milling tool with three cutters, each in the form of cutters with indexable inserts, was used as the milling tool. In this case, with a fixed cutting depth of 0.055 mm and a cutting width of 25 mm, the feed per tooth was varied between 0.02 and 0.125 mm, by means of the table feed, with the milling tool rotation speed being constant at 1492 revolutions per minute.

Example 2

In a further trials series, the feed per tooth was varied in the same manner by means of the table feed for the same closing element with the same machine and the same milling tool as in example 1, at a fixed milling tool rotation speed of 1910 revolutions per minute and a cutting depth of 0.04 mm, as well as the same cutting width of 25 mm.

Example 3

In a further trials series, the pole faces of a laminated armature were produced as a closing element of an electromagnet for a contactor, by milling. The same milling machine and the same milling tool were used as in examples 1 and 2. Once again, the feed per tooth was varied between 0.02 and 0.125 mm by means of the table feed, with a fixed cutting depth of 0.08 mm, a cutting width of 25 mm and a milling tool rotation speed of 1492 revolutions per minute.

Result:

A check was carried out in all of the examples for achievement of the respectively desired values for planarity, roughness and percentage contact area. For each milled face, the planarity averaged over all of the face, an average roughness in accordance with DIN 4768 and the percentage contact area were determined for this purpose. The average planarity in this case denotes the mean discrepancy between the surface and the predetermined or desired shape. The average roughness measures the mean distance between a measurement point on a surface from the mean value of the surface height, that is to say the arithmetic mean of the discrepancy. The percentage contact area is defined as the proportion of the area located between depressions to the overall area, and was determined for a penetration depth of 5 μm.

As the result, it was found that the respectively desired parameters of the surface relating to roughness, planarity and percentage contact area can be produced in a defined and reproducible manner within a narrow tolerance window by milling.

Figure 1:
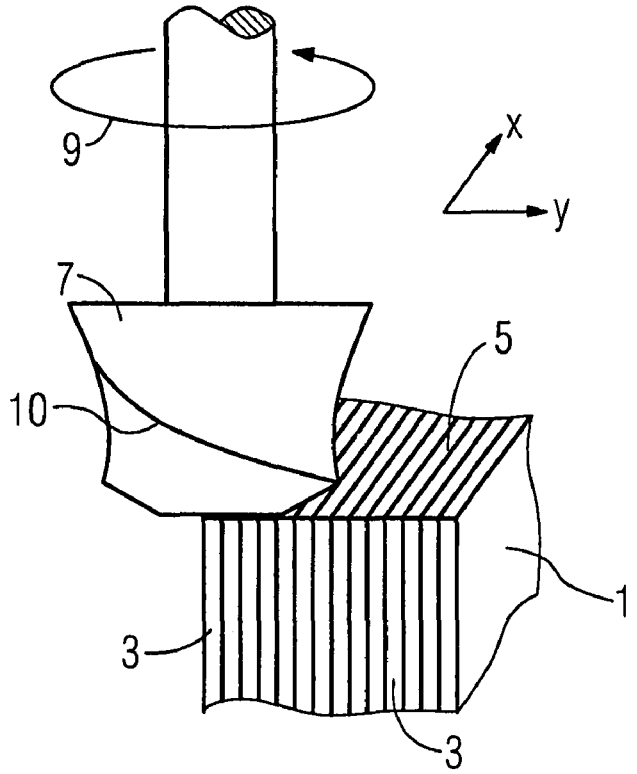
FIG. 1 shows, schematically, the milling treatment of the surface of a closing element, in the form of a laminated core, of an electromagnet.

FIG. 1 shows, schematically, a laminated closing element 1 for an electromechanical switching device. The closing element 1, for example the armature of the electromagnet, is composed of packetized laminates 3. The pole face 5 with respect to which the laminates 3 are aligned transversely is removed by way of a milling tool 7. In this case, the milling tool 7 rotates in the direction of the illustrated arrow 9. At the same time, the milling tool is moved on predetermined paths with respect to the directions x and Y, as shown, over the contact face 5. For this purpose, the milling tool 7 has cutting edges 10 in order to remove stamped edges and uneven features. The cutting edges 10 may in this case, in particular, be in the form of replaceable small cutters with indexable inserts.

Figure 2:
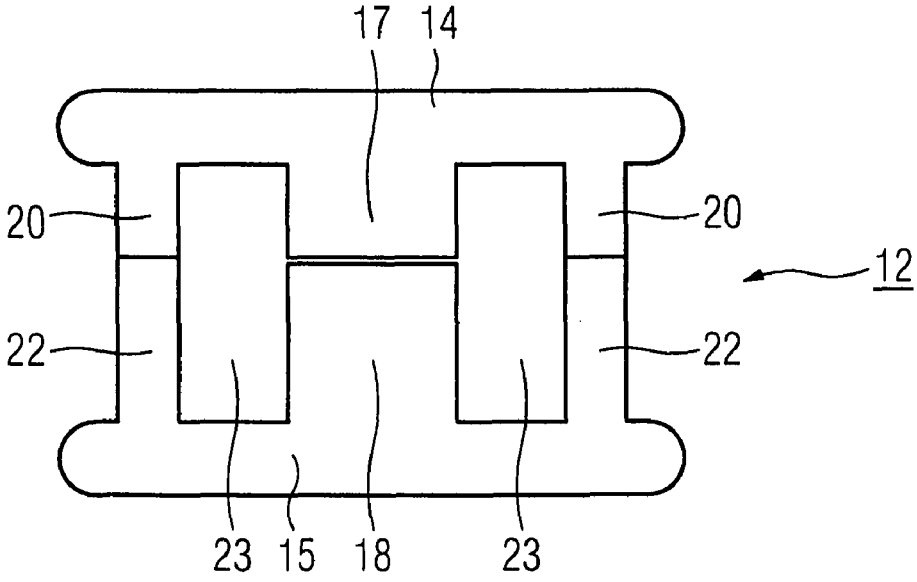
FIG. 2 shows, schematically, an electromagnet for an electromechanical switching device.

FIG. 2 shows, schematically, an electromagnet 12 for an electromechanical switching device. The armature 14 and yoke 15 of the electromagnet 12 are laminated, and each have a center part 17 and 18, respectively, and two outer pole limbs 20 and 22, respectively. Coils can be inserted into the intermediate spaces 23—not shown. The pole faces 24 are milled.

Figure 3:
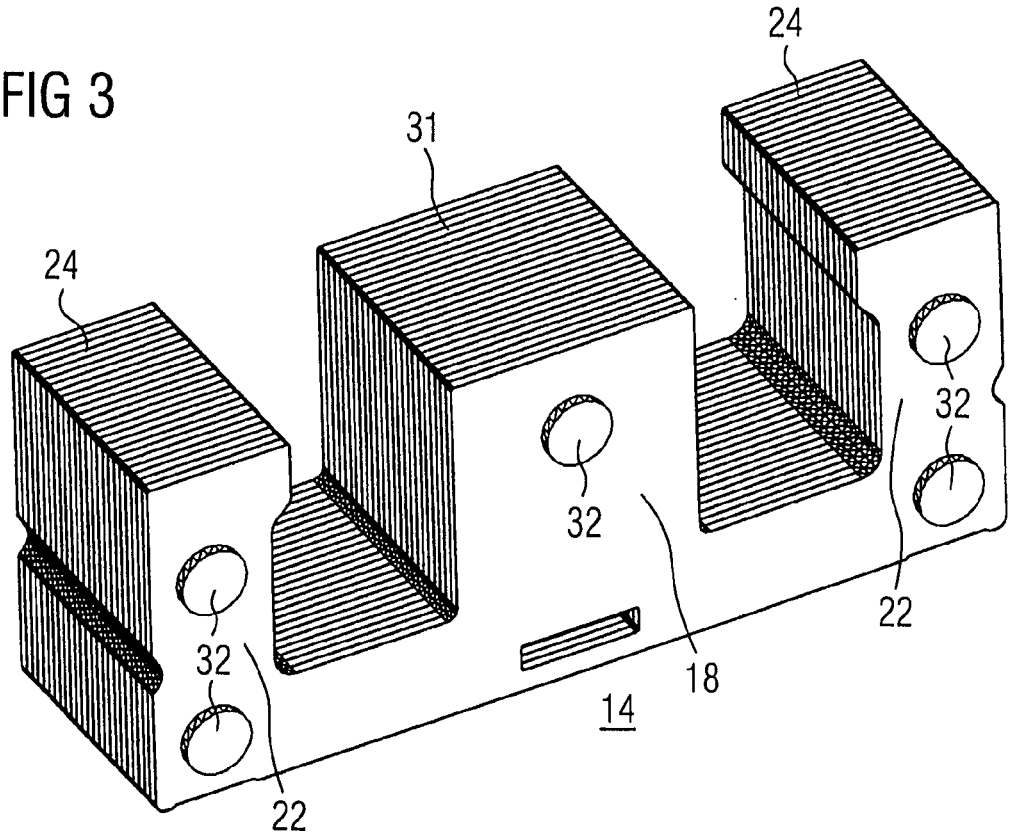
FIG. 3 shows a pole face of an armature.

FIG. 3 shows an armature 14 which was assembled from laminates joined by rivets 32. The outer pole faces 24, that is to say the end faces of the pole limbs 22 of the armature 14, are milled according to an embodiment of the invention. The pole face 31 of the center pole limb 18 can also be milled.

Figure 4:
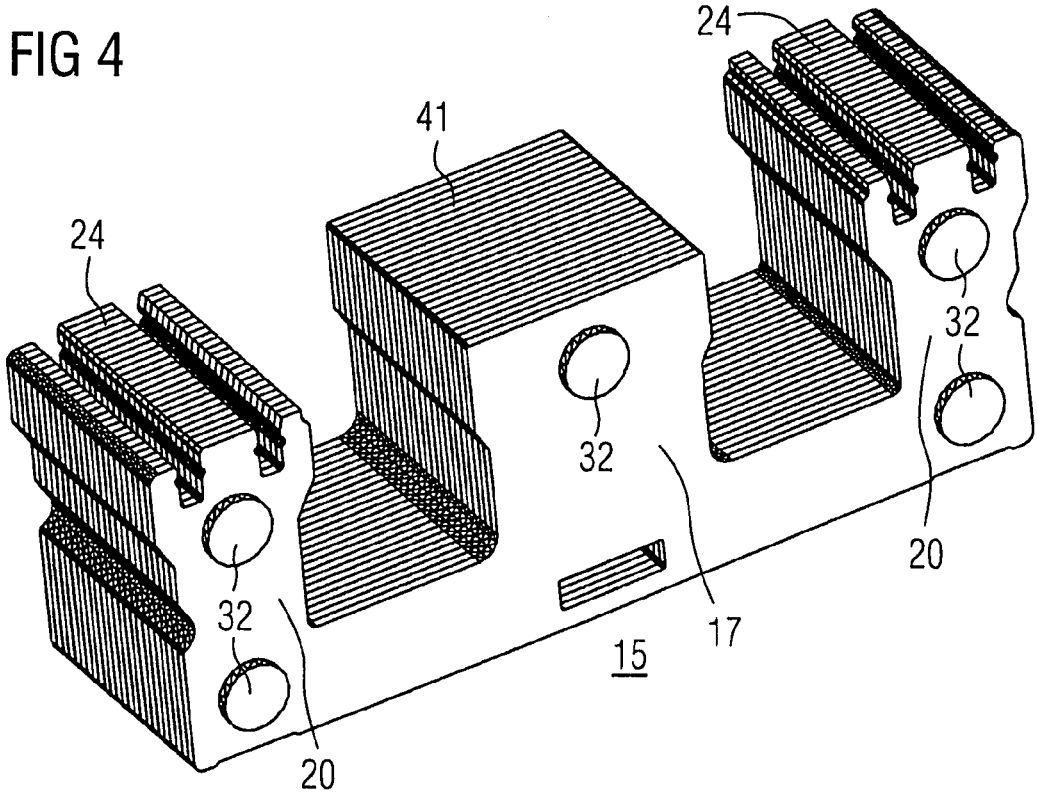
FIG. 4 shows a pole face of a yoke.

FIG. 4 shows a yoke 15 which has been assembled from laminates joined by rivets 32. The outer pole faces 24, that is to say the end faces of the pole limbs 20 of the yoke 15, are milled according to an embodiment of the invention. Since the center pole limb 17 of the yoke 15 is considerably shorter than the outer pole limbs 20, the pole face 41 of the center pole limb 17 is preferably not milled. The pole face 41 may, however, also be milled if the center pole limb 17 is not shorter, or if a milling tool 7 appropriate for its size is available.

An electromagnet is preferably implemented with an armature 14 and a yoke 15 of the type mentioned above. The coil is then wound around the center pole limb 18 of the armature 14.

When the electromagnet is used in an electromechanical switching device, in particular a contactor, the armature 14 and/or the yoke 15 are/is furthermore oiled. Improved damping in the event of bouncing of the armature 14 onto the yoke 15 is achieved in the event of repeated closure by the oil that is located between the individual laminates emerging as a result of the shocks.

Figure 5:
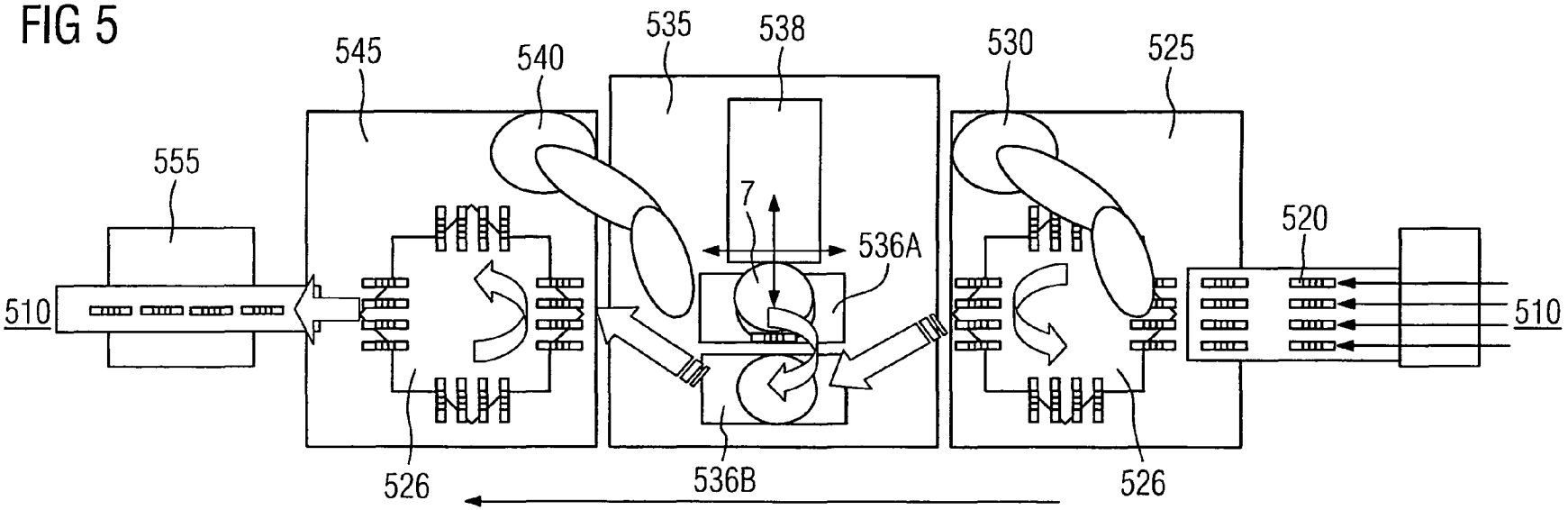
FIG. 5 shows a processing station in the production line.

FIG. 5 shows a processing station 525, 535, 545 in the production line 510. The processing station 525, 535, 545 is designed to carry out the method according to an embodiment of the invention.

Stamped parts 520, which may preferably be both armatures 14 and yokes 15, are conveyed sequentially on the conveyor belt. By way of example, four rows 520 are conveyed alongside one another in FIG. 5.

The rows 520 of stamped parts coming from the production line 510 are placed on a conveyor table 526, which can rotate, in the loading station 525 by means of a first robot 530, preferably in rows. The robot 530 also carries out the unloading process from the conveyor table to the milling station 535.

The milling station 535 receives the stamped parts to be processed, preferably sequentially. FIG. 5 shows the milling station with two workpiece carriers 536A, 536B, allowing continuous processing of the stamped parts. However, other configurations are also possible.

The pole face is milled in the milling station 535 by relative movement between one of the workpiece carriers 536A and the milling tool 7.

A further robot 540 removes the milled stamped parts from a workpiece carrier 536A from the milling station 535 and passes them to the discharge station 545, preferably sequentially onto the conveyor table 526 which can rotate, as soon as the stamped parts which have been placed on the workpiece carrier 536A have been milled. At the same time, milling is carried out on the other workpiece carrier 536B, and the first robot 530 fills the first workpiece carrier 536A again.

The robot 540 moves the milled stamps parts, which are located on the conveyor table 526 which can rotate, back to the conveyor belt 510 via the loading station 555.

Figure 6:
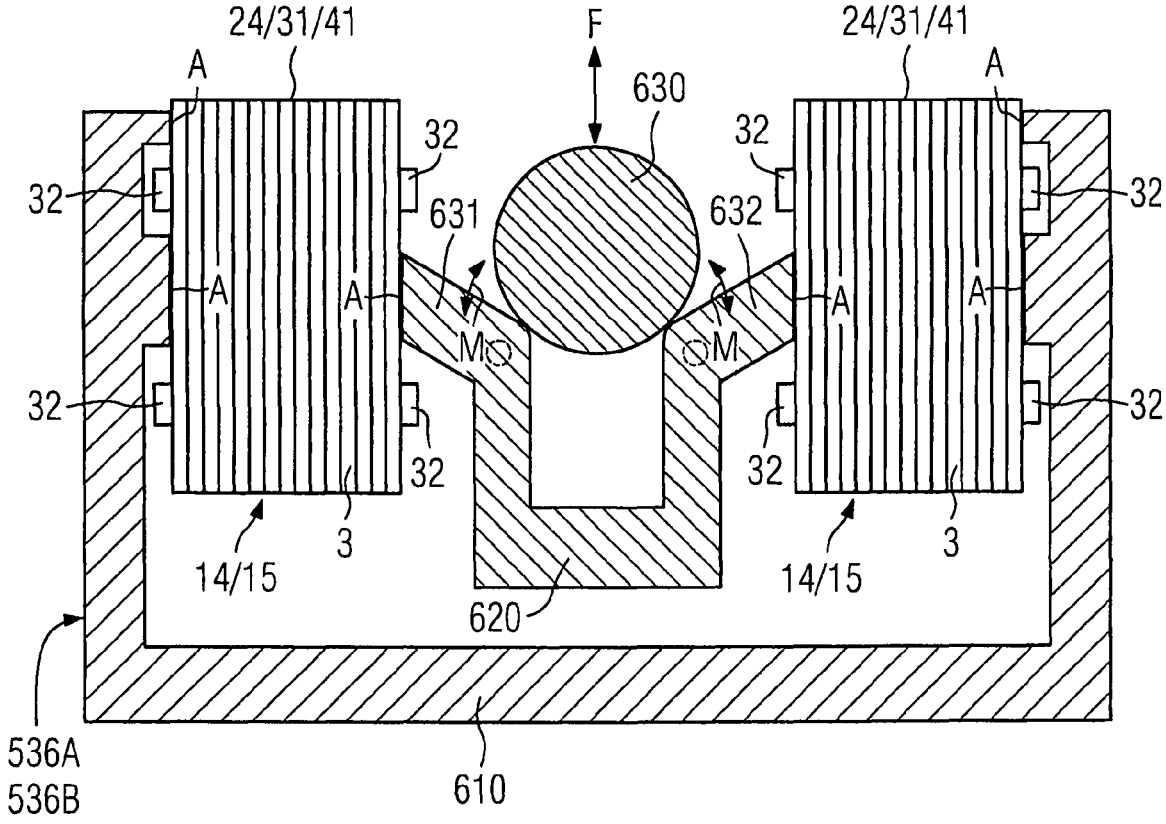
FIG. 6 shows a lifting device in the processing station.

FIG. 6 shows a lifting device in the processing station 535, by way of which the stamped parts are lifted before being milled. It is easiest for the lifting device to be located in the workpiece carrier 536A, 536B, although other configurations are also feasible.

The armatures 14 and the yokes 15 are lifted, preferably sequentially, by movement of a lifting device, such as a profiled rod 630. The profiled rod 630 lifts limbs 631, 632, which are supported by way of an anchorage M and clamp the workpiece to be milled between the limbs 632, 632 and the side walls 610 such that the pole faces 24, 31 and 41 can be lifted somewhat above the upper edge of the side walls 610. The stops A in the side walls 610 and in the limbs 631, 632 are preferably designed such that they clamp the riveted stamped parts around the rivets 32 or alongside the rivets 32, but such that no force or moment, or only a minimal force or moment, acts on the rivets 32, in order to better prevent deformation of the pole limbs.

Figure 7:
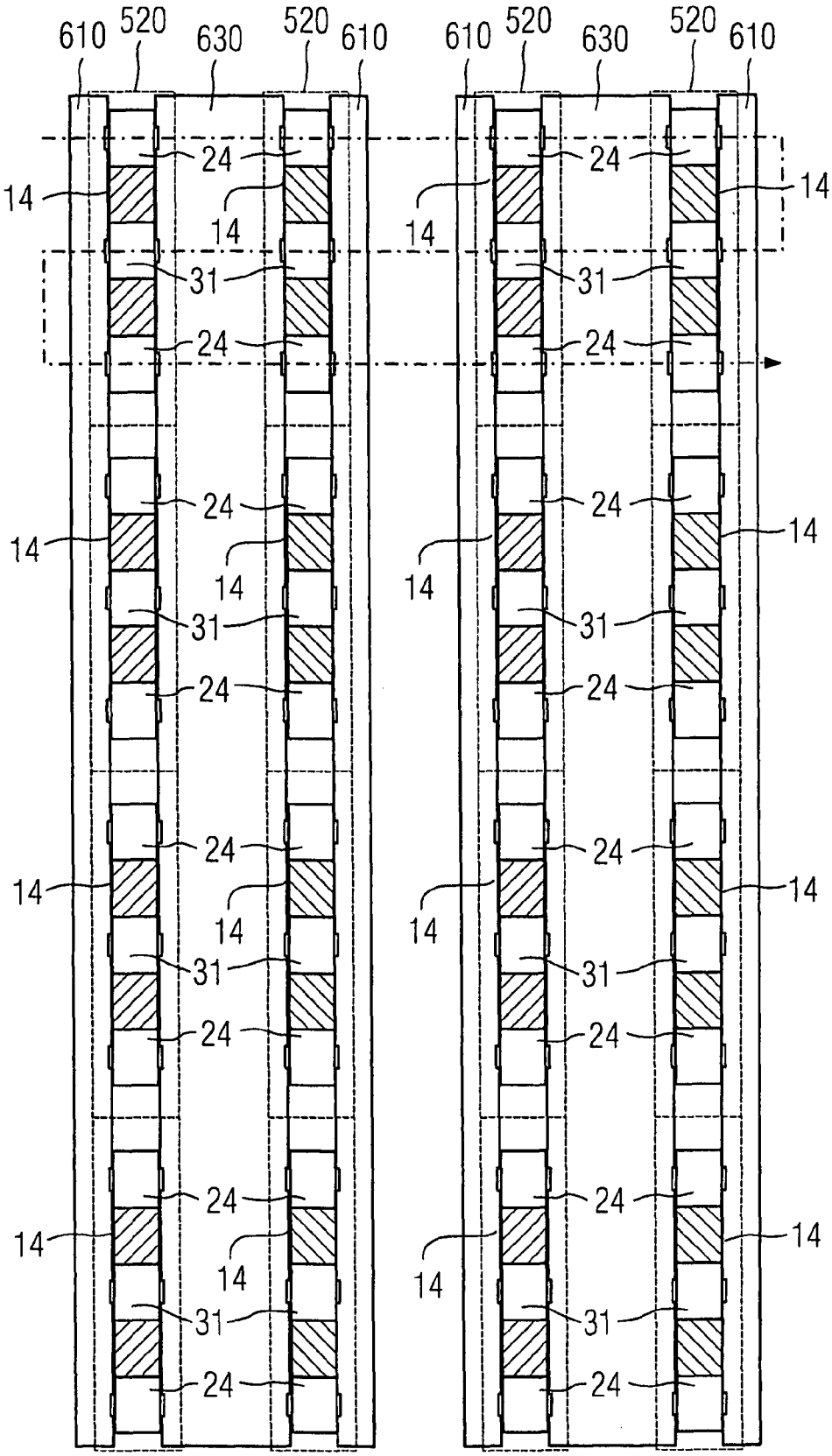
FIGS. 7-9 show possible relative movements between the workpiece carrier and the milling machine in the milling station.
Figure 8:
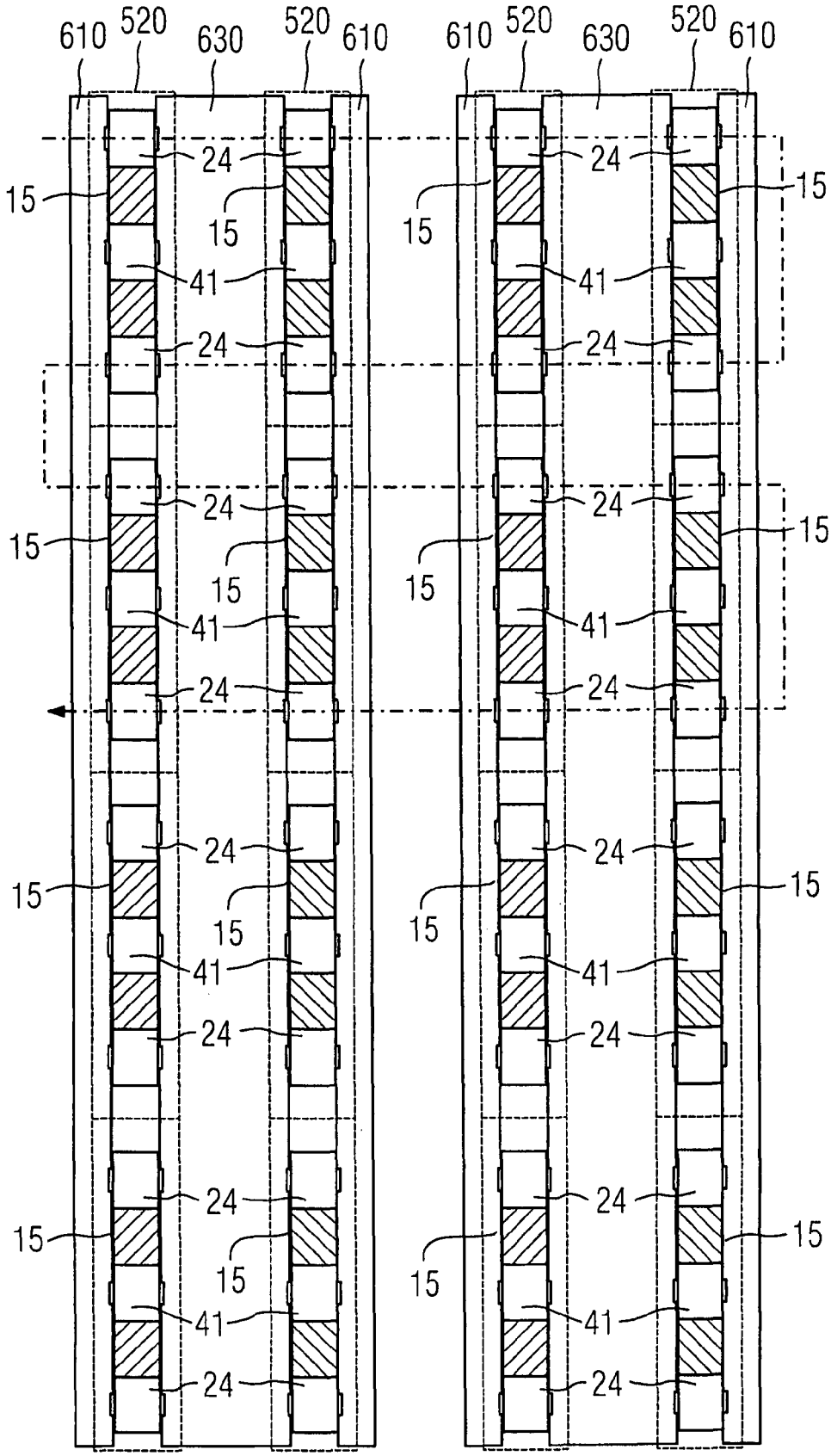
Figure 9:
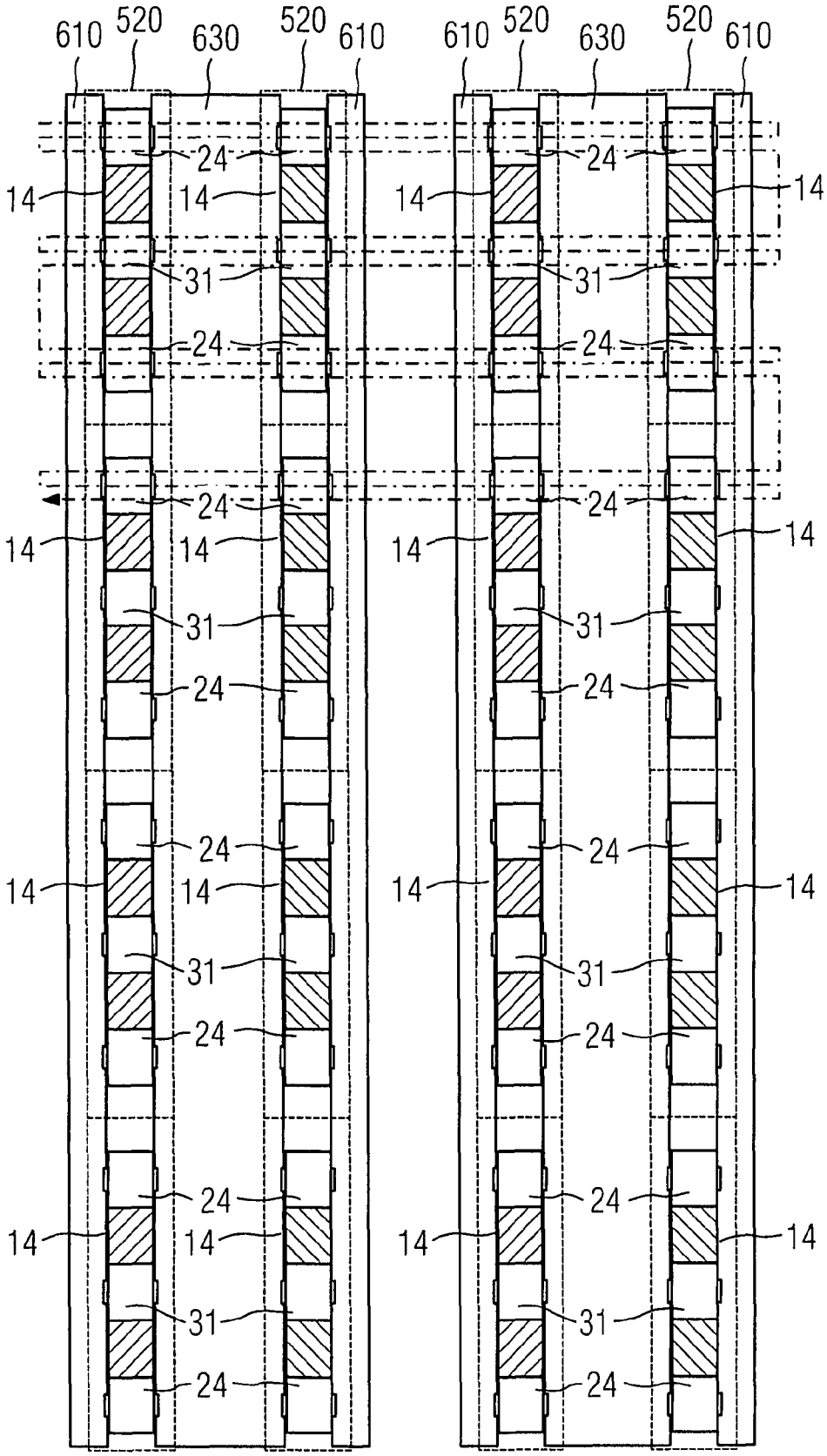

FIGS. 7 to 9 show possible relative movements between the workpiece carrier 536A, 536B and the milling head 7 in the milling station 535.

Preferably, as is shown in FIG. 7, a pole face of a stamped element is milled by a continuous movement. A further pole face is then milled in the reverse movement. In other words, the milling process is carried out in alternating directions, preferably to and fro.

If the stamped elements are arranged sequentially, and the rows 520 are located alongside one another, this allows a relative milling movement as shown in FIG. 7. The number of rows may be varied as required, and the example in FIG. 7 shows four rows 520, each with four stamped parts. The number of stamped parts can also be varied as required. If the stamped parts are armatures 14, all three pole faces 24, 31, 24 can be milled. According to an embodiment of the invention, at least the pole faces 24 of the outer pole limbs 20, 22 are milled.

If the stamped parts are yokes 15, either all or only the outer pole faces 24 can be milled, depending on the size of the yoke 15. If the yoke 15 is relatively small, it may not be possible to mill the center pole face 41. This is the situation in particular when the milling tool 7 is larger than the distance between the pole faces 24 of the yoke 15, preferably because the center pole limb 17 is somewhat shorter than the outer pole limbs 20. FIG. 8 shows the subsequent milling movement.

It is also possible, particularly with somewhat larger stamped parts, for it not to be possible to mill one pole face 24, 31 or 41 with only one milling movement. A plurality of return movements are then required, for example as illustrated in FIG. 9. The number of milling movements per pole face may therefore be 1, 2, 3, 4 or more.

In all of the illustrations in FIGS. 7 to 9, the milling process is carried out at right angles to the laminates 3 of each stamped part, in order to deform the riveted laminated cores as little as possible.

Although embodiments of the invention have been described above on the basis of milling as the processing method for processing of the pole faces, it is quite possible for some other machining processing method to be used instead of this or together with it, for example planing or turning. However, since the cutter inserts of a milling tool are quite simple and can be replaced easily, milling is preferred here.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for production of a pole face of a metallic closing element of an electromagnet, comprising:

processing one surface of a rough stamped part of the closing element using a machining method; and machining a roughened surface onto the pole face forming a roughened contact surface onto the closing element, wherein the machining includes milling away a surface of the pole face at a fixed depth and width below the surface of the pole face.

2. The method as claimed in claim 1, wherein a laminated core is used as the rough stamped part, with laminates of the laminated core being packetized transversely with respect to the surface.

3. The method as claimed in claim 2, further comprising attaching the laminates to one another by rivets.

4. The method as claimed in claim 3, further comprising lifting the stamped part before processing by the machining method.

5. The method as claimed in claim 4, wherein the stamped part is raised around the rivets or alongside the rivets before being processed by the machining method.

6. The method as claimed in claim 5, wherein the lifting of the stamped part is by way of a lifting device, arranged to clamp the stamped part close to a processing plane of the machining method.

7. The method as claimed in claim 6, wherein the lifting includes lifting a row of stamped parts.

8. The method as claimed in claim 5, wherein the stamped part is lifted by way of a lifting device, arranged to clamp the stamped part close to a milling plane of the machining method.

9. The method as claimed in claim 2, wherein the laminates are attached to one another by rivets.

10. The method as claimed in claim 1, wherein the milling of the pole face is subjected to at least one of open-loop and closed-loop control using a feed rate and a rotation speed of a milling tool as input variables.

11. The method as claimed in claim 10, wherein the milling is carried out at right angles to laminates of a laminated core used as the rough stamped part.

12. The method as claimed in claim 1, wherein the milling is carried out at right angles to laminates of a laminated core used as the rough stamped part.

13. The method as claimed in claim 1, wherein the milling is carried out in an alternating direction.

14. The method of claim 1, wherein the method is for production of a pole face of a metallic closing element of an electromechanical switching device including the electromagnet.

* * * * *